United States Patent [19]

Peters

[11] Patent Number: 4,608,909

[45] Date of Patent: Sep. 2, 1986

[54] INTERCHANGEABLE BARREL FOR SMALL ARMS

[76] Inventor: Franz-Josef Peters, Senefelderstrasse 19, D-4790 Paderborn 1, Fed. Rep. of Germany

[21] Appl. No.: 495,258

[22] Filed: May 17, 1983

[30] Foreign Application Priority Data

Nov. 23, 1982 [DE] Fed. Rep. of Germany ..... 3243241

[51] Int. Cl.[4] ..... F41C 21/22

[52] U.S. Cl. ..... 89/196; 42/77; 42/1.07; 42/75.02

[58] Field of Search ..... 89/29, 128, 163, 195, 89/196; 42/77, 1 Q, 75 B

[56] References Cited

U.S. PATENT DOCUMENTS

| | | | |
|---|---|---|---|
| 754,412 | 3/1904 | Bekans | 89/29 |
| 2,846,925 | 8/1958 | Norman | 89/163 |
| 3,150,458 | 9/1964 | Browning | 42/75 B |
| 3,657,959 | 4/1972 | Kart | 89/128 |
| 3,731,418 | 5/1973 | Birkenhagen et al. | 42/75 B |
| 3,834,053 | 9/1974 | Bielfeldt et al. | 42/1 Q |
| 3,883,977 | 5/1975 | McClure | 42/75 B |
| 4,031,808 | 6/1977 | Raville | 89/163 |
| 4,109,403 | 8/1978 | Badali | 42/75 B |
| 4,253,377 | 3/1981 | Arnett | 42/77 |

FOREIGN PATENT DOCUMENTS

| | | |
|---|---|---|
| 678684 | 7/1939 | Fed. Rep. of Germany . |
| 1703417 | 3/1972 | Fed. Rep. of Germany . |

OTHER PUBLICATIONS

W. H. B. Smith, Small Arms of the World, "The Falling Block System", 1973, pp. 49–52.

*Primary Examiner*—Stephen C. Bentley

*Attorney, Agent, or Firm*—Schwartz, Jeffery, Schwaab, Mack, Blumenthal & Evans

[57] ABSTRACT

Disclosed is an interchangeable barrel for small arms of the type having sliding breechblocks, comprising a housing with a guide surface inclined downwardly to the rear, for releasing the barrel during recoil. In order to mount the interchangeable barrel in the weapon without any play, the barrel has an adjustable spreading element which can be wedged against the declining guide surface of the weapon.

5 Claims, 11 Drawing Figures

INTERCHANGEABLE BARREL FOR SMALL ARMS

BACKGROUND OF THE INVENTION

The invention concerns an interchangeable barrel for small arms with a sliding breechblock, comprising a housing with a rearwardly inclining guiding surface to release the barrel during recoil.

In a series of small firearms with a sliding breechblock, upon firing a round the barrel and the breechblock are initially displaced together toward the rear, and then the barrel is released with respect to the breechblock which continues to move to the rear, so that the empty cartridge may be ejected by means of an appropriate mechanism and a new cartridge inserted in the rear end of the barrel. The connection between the barrel and the breechblock is obtained in the case of certain types of weapons by lowering the rear end of the barrel. This is effected by means of a guiding surface inclined toward the rear in the weapon housing, upon which the rear end of the barrel runs up with suitable guide elements. The present invention concerns weapons of this type.

Ammunition for large caliber small arms is relatively expensive. Consequently, interchangeable systems are known making it possible to replace a large caliber barrel by a barrel for small caliber ammunition, for example 22 caliber. In connection with such devices, it is usually difficult to fasten the interchangeable barrel without clearance because weapons of the aforementioned type, for the most part, are not produced with close tolerances. Rather, as a rule the individual parts of each weapon are fitted to each other. It is therefore not readily possible to manufacture an interchangeable barrel which can be mounted on any desired weapon of the basic underlying type without clearance or play.

SUMMARY OF THE INVENTION

It is therefore an object of the present invention to provide an interchangeable barrel of the abovementioned type which can be mounted on any desired weapon in a simple manner, without clearance or play.

In accomplishing the foregoing objects, there has been provided in accordance with the present invention an interchangeable barrel for small arms of the type having a sliding breechblock and including a housing with a guiding surface inclined in the downward direction toward the rear, for releasing the barrel during recoil, comprising an interchangeable barrel element and an adjustable spreading element on the interchangeable barrel for adjustably resting against the rearwardly inclined guide surface of the housing. In one embodiment, the spreading element comprises a transverse pin displaceable in the longitudinal direction of the interchangeable barrel, with the two free ends of said transverse pin exiting from the interchangeable barrel for engaging areas of the inclined guide surface located on either side of the interchangeable barrel, and adjusting screws for displacing the pin transversely to its longitudinal axis. In another embodiment, the spreading element comprises an eccentric bolt rotatable in the interchangeable barrel and arranged transversely to the longitudinal direction of the interchangeable barrel, the eccentric bolt having two eccentric members exiting from either side of the interchangeable barrel for engaging areas of the inclined guide surface located on either side of the interchangeable barrel.

The interchangeable barrel according to the invention preferably further comprises a ramp located beneath the rear end of the barrel bore for the transfer of cartridges from a magazine into the barrel bore during the change of cartridges. In one embodiment, the ramp terminates below the bottom line of the barrel bore and comprises a configuration suitable to provide a path of the cartridges from the magazine into the barrel bore irrespective of the height of the barrel bore. In another embodiment, the ramp is suspended movably and is adapted to be selectively raised by spring action during a change of cartridges into a position reaching up to the bottom line of the barrel bore.

Further objects, features and advantages of the invention will become apparent from the detailed description of preferred embodiments which follows, when considered together with the attached figures of drawing.

DETAILED DESCRIPTION OF PREFERRED EMBODIMENTS

According to the invention, an adjustable spreading element is provided in the interchangeable barrel for support on the declining guiding surface of the housing. With the aid of the spreading element, the barrel can be fixedly wedged in between the inclined guiding surface and an arresting lever bolt immobilizing the barrel in the forward direction. The spreading element may consist of a transverse pin passing through the barrel which is displaceable by means of adjusting screws in an elongated hole, or it may consist of an eccentric bolt or the like.

When using the small caliber barrel, the latter is thus fixedly immobilized with respect to the housing and not locked together with the breechblock. In view of the lower explosive pressures of small caliber ammunition, this does not cause any problems, while at the same time yielding the advantage that the immobilized barrel results in increased firing accuracy, so that the weapon may be used for sporting purposes or target practice and assures a higher firing accuracy.

A ramp extends from the rear end of the barrel which is intended to guide cartridges during reloading from a magazine into the barrel. The ramp has a convex configuration so that the cartridges may be raised to the greater height required by the narrower bore of the barrel and so that positional inaccuracies in the longitudinal direction of the weapon are deemphasized.

Preferred embodiments will be explained in more detail with the aid of the drawings attached hereto.

Figure 1:
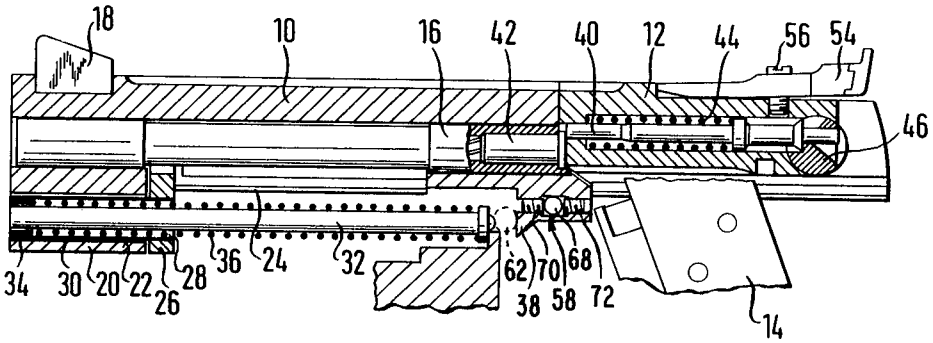
FIG. 1 is a partial lateral elevation of a weapon with the interchangeable barrel according to the invention, in a partial section.

In FIG. 1 is shown a barrel piece 10 of an interchangeable barrel, a sliding breechblock 12 and magazine 14. In a bore of the barrel piece (which is not shown in more detail) the sleeve-shaped barrel 16 itself is positioned. On the front end of the barrel piece 10, to the left in FIG. 1, the front sight 18 of the weapon is mounted. Below the sight, a downwardly protruding shoulder 20 is located on the barrel piece, with a bore 22 being provided in said shoulder 20 and extending parallel to the barrel.

The barrel piece may be pushed onto the housing of the weapon, not shown, in a guide, for example a conventional type of dovetail guide, again not shown.

The sliding breechblock 12 may be displaced in a similar manner longitudinally with respect to the housing. The breechblock guide extends along the underside of the barrel piece 10 and has a shoulder 26 at its front end, to the left in FIG. 1, said shoulder protruding in the downward direction and having a cross section corresponding essentially to that of the shoulder 20 of the barrel piece and containing a bore 28 which serves to extend the bore 22. In the bore 28 a forwardly extending spring guide sleeve 30 is located, extending into the bore 22 of the shoulder 20 and terminating flush with the front end of the barrel piece 10. Concentrically within the spring guide sleeve 30, a spring guide rod 32 is located, which in its rest position, shown in FIG. 1, again terminates flush with the front end of the barrel piece 10. At the front end of the spring guide sleeve and the spring guide rod, the spring guide sleeve has an inwardly protruding flange 34, serving as the spring plate for a closing spring in the form of a helical compression spring surrounding the spring guide rod 32 over its entire length. The rear end of the spring guide rod 32 is fastened to a downwardly protruding shoulder 38 of the barrel piece 10.

When the sliding breechblock 12 together with the downwardly protruding shoulder 26 and the spring guide sleeve 30 are displaced to the right in FIG. 1 as the result of the explosion-pressure of a cartridge, the closing spring 36 is compressed so that the breechblock 12 is returned from its rear terminal position into its front terminal position, shown in FIG. 1, following the automatic exchange of cartridges.

Figure 3:
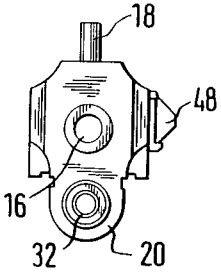
FIG. 3 is a front elevation of the weapon according to FIG. 1.

Within the breechblock 12, a firing pin 40 is shown which, upon the firing of a round, impacts the rear rim area of a cartridge 42. The firing pin is prestressed to the rear by a firing pin spring 44. A safety shaft 46, which may be rotated from the outside with the aid of a safety lever 48 (FIGS. 2 and 3), serves to lock the firing pin, thereby securing the weapon.

Figure 2:
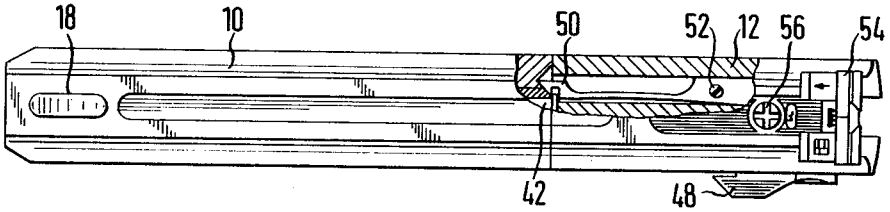
FIG. 2 is a corresponding top view.

FIG. 2 further shows an extractor 50 to extract the empty cartridges, which is secured in the breechblock by means of a fastening screw 52. The extractor grips the rear protruding rim of a cartridge 42 and carries the empty shell to the rear, following the firing of a round, so that the shell may be ejected.

FIG. 1 further shows on the rear end of the breechblock 12 a conventional rear sight 54, which is mounted by means of a screw 56.

Figure 4:
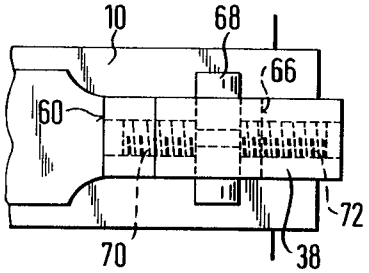
FIGS. 4 and 5 show in a top view and a lateral elevation of a first embodiment of a spreading device according to the invention.
Figure 5:
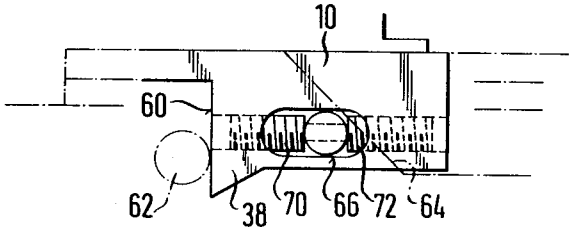

Finally, a mechanism designated in its entirely by 58 may be seen in FIG. 1; it serves to secure the barrel piece 10 in its guide in the longitudinal direction of the weapon. This mechanism shall be explained hereinbelow in more detail with the aid of FIGS. 4 to 7. FIGS. 4 and 5 show in a schematic partial representation the rear terminal area of the barrel piece 10. In FIG. 5, the rear, lower shoulder of the barrel piece, designated by 38 in FIG. 1, is shown in particular.

This shoulder 38 has a vertical front surface 60, resting against an arresting or cam lever bolt 62 which extends in the transverse direction of the housing, with said cam lever bolt 62 determining the front terminal position of the barrel piece. It is, however, not possible to provide a fixed stop for the barrel piece in the form of a shoulder on the housing, since only relatively coarse tolerances are observed in the manufacture of the housing and in particular the position of the diameter of the arresting lever bolt. The mounting of the interchangeable barrel without clearance would therefore be impossible, at least in the case of some of the weapons of any particular class. According to the invention, consequently a spreading mechanism is provided, which wedges the barrel piece against the arresting lever bolt 62, as explained hereinbelow.

In the basic weapon with which one begins, there is found a guide surface 64 extending rearwardly and downwardly, shown with a phantom line in FIG. 5. As mentioned hereinabove, the guiding surface 64 serves to release the barrel at a certain position during the rearward movement of the barrel and the breech. A release action of this type is provided, for example, in the case of the small arms Model M 39, M 59, M 52, M 539 and M 559 of the Smith & Wesson Co.

According to FIGS. 4 and 5, in the lower shoulder 38 of the barrel piece 10, there is an elongate hole 66 extending in the longitudinal direction of the weapon and passing through the shoulder in the transverse direction, through which a transverse pin 68 (FIG. 4) is inserted, exiting on both sides on the shoulder 38. The transverse pin 68 may be displaced transversely to its longitudinal direction in the elongate hole with the aid of two adjusting screws 70, 72 and pressed with its ends exiting from the shoulder 38 against the guiding surface 64, which consists of two partial areas located on either side of the shoulder 38. In this manner, the barrel piece 10 may be wedged between the arresting lever bolt 62 and the guiding surface 64 and immobilized in the longitudinal direction of the weapon without clearance or play.

Figure 6:
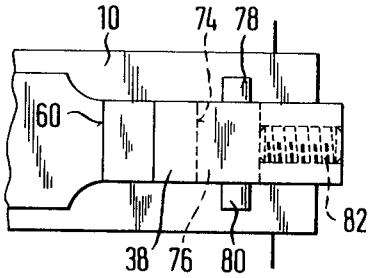
FIGS. 6 and 7 are corresponding views of a second embodiment of the spreading device.
Figure 7:
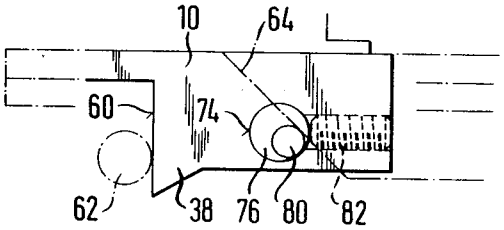

FIGS. 6 and 7 show a further embodiment of the spreading mechanism having an eccentric bolt 76 rotatable in the transverse bore 74 of the barrel piece 10. Two eccentrics 78, 80 exit on both sides from the shoulder 38 and may be pressed by a rotation of the eccentric bolt against the inclined guiding surface 64. An adjusting screw 82, the axis of which is perpendicular to that of the eccentric bolt 76, serves to secure the eccentric bolt in the direction of rotation.

Figure 8:
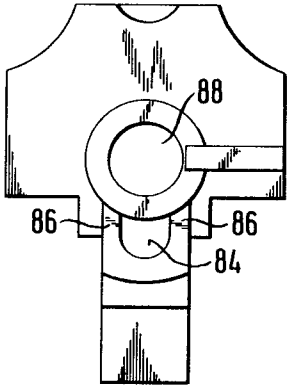

With reference to FIGS. 1 and 8, a description will now be given of the transition area between the barrel piece and the breech and of a ramp located at the rear end of the barrel piece, serving as a guide for the cartridges from a magazine into the cartridge seat in the rear end of the barrel piece.

As seen in FIG. 1, the partition plane between the barrel piece and the breechblock is located at the height of the percussion surface. From the rear frontal surface of the barrel piece, the ramp extends obliquely downwardly and to the rear in the direction of the magazine 14. In the basic weapon, for example, an FN Highpower or the like, the ramp extends obliquely upwardly to the lower edge of the barrel bore. Since the lower edge of the barrel bore is higher in the case of a smaller bore, it is necessary to displace the cartridge guidance higher on the ramp for an interchangeable barrel. However, in the case of certain weapons it is not immediately possible to provide a higher, inclined ramp, since the configuration of the unchanged breechblock of the basic weapon does not permit it, because, for example, actuating levers are located in the front area of the breechblock.

For this reason, the ramp according to the invention shown in FIG. 8 has a geometric form permitting a higher lifting of the cartridges, without the ramp having to be extended to the lower edge of the bore of the interchangeable barrel.

Figure 9:
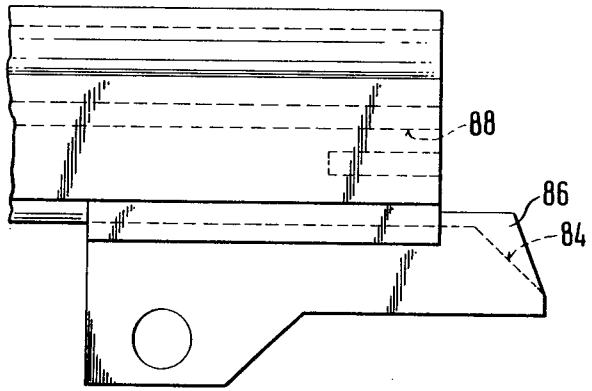
FIGS. 8 to 11 show two different embodiments of a ramp at the rear end of the barrel.

A ramp of this type is designated in FIGS. 8 and 9 by reference numeral 84. FIG. 8 shows the rear end of the barrel piece in a rear elevation, while FIG. 9 displays a partial lateral view of this area. The ramp 84 is in the form of a channel and is defined by two lateral guide cheeks or sidewalls 86. It is seen particularly in FIG. 8 that the ramp 84 terminates at a distance below the bottom line of the barrel bore 88. However, the ramp 84 is configured so that it is adequate as a guide for the cartridges coming from the magazine during their entry into the rear end of the barrel bore 88.

Figure 11:
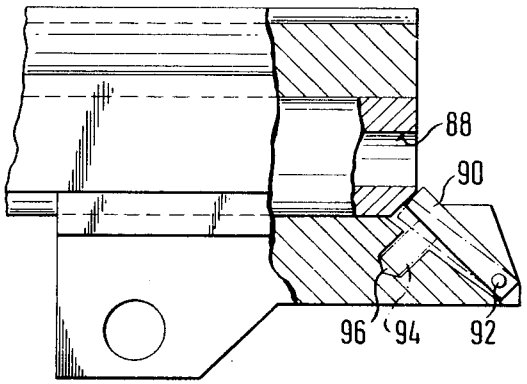
Figure 10:
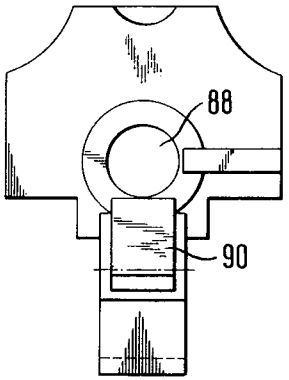

A further embodiment of the ramp (which again may be inserted if a ramp leading to the bottom line of the barrel bore cannot be inserted for reasons of space) is shown in FIGS. 10 and 11. These figures correspond to FIGS. 8 and 9, but display a ramp 90 in the form of a pivoting plate, which during the recoil of the breechblock, and thus during the change of cartridges, is raised by the action of a spring, not shown, into the position indicated by solid lines. In this position the ramp continues or extends in the conventional manner smoothly to the bottom line of the barrel bore 88. Following the change of cartridges, the ramp 90 is depressed by the returning breechblock around an axle pin 92 into the position indicated by the phantom lines, in which it partially frees the previously occupied space. A guide pin 94 is located at the bottom of the ramp 90 which is displaceable in an appropriate guide bore 96 at the end of the barrel piece under the barrel bore 88.

In place of the rocker construction shown in FIGS. 10 and 11, a ramp may be used which avoids the returning breechblock in any alternative manner.

What is claimed is:

1. A small arm having an interchangeable sub-caliber barrel comprising:

a housing;

a sliding breechblock slidably mounted on the housing;

an arresting lever bolt extending through said housing in a direction transverse to the length of the housing;

an interchangeable barrel element having a sub-caliber barrel bore and a downwardly protruding shoulder at a rear portion thereof, said shoulder having a frontal surface abutting against the arresting lever bolt;

a rearwardly and downwardly inclined guide surface formed on the housing near the rear portion of the barrel; and an adjustable spreading element on the interchangeable barrel adjustably resting against the rearwardly-inclined guide surface of the housing for fixedly clamping the barrel in the housing by exerting a spreading force between the guide surface and the arresting lever bolt.

2. A small arm according to claim 1, wherein the spreading element comprises a transverse pin displaceable in the longitudinal direction of the interchangeable barrel, said transverse pin having two free ends exiting from the interchangeable barrel for engaging areas of the inclined guide surface located on either side of the interchangeable barrel and adjusting screws for displacing said pin transversely to its longitudinal axis.

3. A small arm according to claim 1, wherein the spreading element comprises an eccentric bolt rotatable in the interchangeable barrel and arranged transversely to the longitudinal direction of said interchangeable barrel, said eccentric bolt having two eccentric members exiting from either side of the interchangeable barrel for engaging areas of the inclined guide surface located on either side of the interchangeable barrel.

4. A small arm according to claim 1, further comprising a ramp located beneath the rear end of the barrel bore for the transfer of cartridges from a magazine into the barrel bore during the change of cartridges, wherein the ramp terminates below the bottom line of the barrel bore and comprises a configuration suitable to provide a path of the cartridges from the magazine into the barrel bore irrespective of the height of the barrel bore.

5. A small arm according to claim 1, further comprising a ramp located below the rear end of the barrel bore for the transfer of cartridges from a magazine into the barrel bore during the change of cartridges, wherein the ramp is suspended movably and is adapted to be selectively raised by spring action during a change of cartridges into a position reaching up to the bottom line of the barrel bore.

* * * * *